US009579897B1

(12) United States Patent
Furuhata et al.

(10) Patent No.: US 9,579,897 B1
(45) Date of Patent: Feb. 28, 2017

(54) LIQUID EJECTION APPARATUS

(71) Applicant: Brother Kogyo Kabushiki Kaisha, Nagoya-shi, Aichi-ken (JP)

(72) Inventors: Yoshiharu Furuhata, Nagoya (JP); Tomohiro Nodsu, Seto (JP); Shin Hasegawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/085,369

(22) Filed: Mar. 30, 2016

(30) Foreign Application Priority Data

Sep. 9, 2015 (JP) ..... 2015-177128

(51) Int. Cl.
*B41J 2/165* (2006.01)
*B41J 2/045* (2006.01)

(52) U.S. Cl.
CPC ..... *B41J 2/16517* (2013.01); *B41J 2/04596* (2013.01); *B41J 2/165* (2013.01); *B41J 2/16526* (2013.01); *B41J 2002/16573* (2013.01)

(58) Field of Classification Search
CPC ..... B41J 2/165; B41J 2/16517; B41J 2002/16573; B41J 2/04596; B41J 2/1652; B41J 2/16526
See application file for complete search history.

(56) References Cited

U.S. PATENT DOCUMENTS 6,402,292 B1 6/2002 Ninomiya
8,459,766 B2 6/2013 Shinohara et al.
8,888,220 B2 11/2014 Sato
8,991,973 B1 3/2015 Sugiura et al.
2006/0284908 A1* 12/2006 Iwao ..... B41J 2/04525 347/9
2007/0091140 A1* 4/2007 Taga ..... B41J 2/165 347/30
2012/0050361 A1 3/2012 Shinohara et al.
2014/0152731 A1 6/2014 Sato
2015/0091977 A1 4/2015 Sugiura et al.
(Continued)

FOREIGN PATENT DOCUMENTS

JP H11-198395 A 7/1999
JP 2005-280027 A 10/2005
(Continued)

*Primary Examiner* — Julian Huffman
(74) *Attorney, Agent, or Firm* — Banner & Witcoff, Ltd.

(57) ABSTRACT

An image recording apparatus includes: an ink-jet head including an energy applier that causes ejection of ink; a medium supplier that supplies a recording medium; a first sensor provided on a supply path through which the recording medium is to be supplied to the ink-jet head by the medium supplier; and a controller. The controller controls the energy applier to perform first preparatory driving including flushing before the ink-jet head performs image recording. The controller controls the energy applier to perform second preparatory driving including the flushing or ink agitation driving after the first preparatory driving and detection of the recording medium by the first sensor. The controller controls the energy applier to perform the second preparatory driving in accordance with an elapsed time extending from an input of a recording command to the detection of the recording medium by the first sensor.

10 Claims, 15 Drawing Sheets

(56) References Cited

U.S. PATENT DOCUMENTS

2016/0052308 A1* 2/2016 Sahara ..... B41J 11/0095
347/16

FOREIGN PATENT DOCUMENTS

| | | | |
|---|---|---|---|
| JP | 2008-037006 | A | 2/2008 |
| JP | 2012-045848 | A | 3/2012 |
| JP | 2014-108554 | A | 6/2014 |
| JP | 2015-063060 | A | 4/2015 |
| JP | 2015-066717 | A | 4/2015 |

* cited by examiner

STANDBY STATE

UNCAPPING

PREPARATION FOR FLUSHING

FLUSHING

DETECTION MOVEMENT AND INK AGITATION

RETURNING TO REFERENCE POSITION (FLUSHING POSITION)

STARTING PRINTING MOVEMENT

PRINTING (INK EJECTION)

NORMAL SHEET SUPPLY

SHEET DETECTION BY REGISTER SENSOR

SHEET DETECTION BY MEDIA SENSOR
(DETECTION MOVEMENT)

SHORT PERIOD SLIP IS CAUSED

LONG PERIOD SLIP IS CAUSED

LIQUID EJECTION APPARATUS

CROSS REFERENCE TO RELATED APPLICATION

The present application claims priority from Japanese Patent Application No. 2015-177128, which was filed on Sep. 9, 2015, the disclosure of which is herein incorporated by reference in its entirety.

BACKGROUND

Technical Field

The following disclosure relates to an image recording apparatus.

Description of the Related Art

In ink-jet image recording apparatuses, the viscosity of ink in nozzles of an ink-jet head increases due to drying of the ink during a period in which the ink is not ejected from the nozzles. When printing is started in this state by ejecting the ink from the nozzles onto a recording medium, increase in viscosity of the ink may cause ejection failure in the nozzles, which may result in fading on a printed image. To solve this problem, a conventional image recording apparatus controls an ink-jet head to perform flushing for forcing ink from nozzles to discharge high-viscosity ink from the nozzles during a period in which a recording medium is supplied to the ink-jet head after a print instruction is input.

In such an image recording apparatus, however, a length of time required for supply of the recording medium may be unexpectedly increased due to a slip of a roller for supplying the recording medium to the ink-jet head, for example. In this case, the flushing is finished early although the recording medium has not been supplied. That is, a certain length of time passes from the end of the flushing to the start of printing on the recording medium, during which the viscosity of the ink in the nozzles increases.

To solve this problem, there is known an image recording apparatus configured to discharge ink in flushing after recognizing that a recording medium has been supplied successfully. Specifically, a sheet detector is provided near an end of a path through which a recording sheet (the recording medium) is supplied to the ink-jet head by a sheet-supply roller, and this sheet detector detects the recording sheet supplied along the path. After the detection of the recording sheet by the sheet detector and the recognition of the success of the sheet supply, the image recording apparatus controls the ink-jet head to perform the flushing to discharge the ink whose viscosity has been increased in nozzles.

SUMMARY

The above-described image recording apparatus controls the ink-jet head to perform the flushing after recognizing the success of the sheet supply. Thus, the flushing never ends before the completion of the sheet supply. However, in the case where a length of time required for the sheet supply is considerably increased due to the sheet-supply roller being slipped for a very long time, the viscosity of the ink in the nozzles increases greatly. Accordingly, even when a predetermined amount of the ink is thereafter discharged in the flushing, this flushing may be insufficient to fully eliminate the high-viscosity ink in the nozzles.

Accordingly, an aspect of the disclosure relates to an image recording apparatus configured such that, even in the case where a long time is required for supply of a recording medium, the ink whose viscosity has been increased in the supply can be reliably eliminated just before printing.

In one aspect of the disclosure, an image recording apparatus includes: an ink-jet head including (i) a plurality of nozzles through which the ink-jet head ejects ink and (ii) an energy applier configured to apply ejection energy to the ink, the ejection energy causing the ink to be ejected from the plurality of nozzles; a medium supplier configured to supply a recording medium to a recording start position at which the ink-jet head is started to record an image on the recording medium; a first sensor provided on a supply path through which the recording medium is to be supplied to the ink-jet head by the medium supplier, the first sensor being configured to detect the recording medium supplied to the ink-jet head by the medium supplier; and a controller. The controller is configured to perform: controlling the energy applier to perform first preparatory driving before the ink-jet head performs image recording on the recording medium. The first preparatory driving includes flushing in which the ink-jet head discharges the ink from the plurality of nozzles; controlling the energy applier to perform second preparatory driving after the first preparatory driving and detection of the recording medium by the first sensor, the second preparatory driving including one of the flushing and ink agitation driving in which the ink in the plurality of nozzles are agitated without being ejected; and controlling the energy applier to perform the second preparatory driving in accordance with an elapsed time extending from an input of a recording command to the detection of the recording medium by the first sensor.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings. The following description will be provided assuming that front, rear, right, left, upper, and lower sides of an ink-jet printer 1 are defined with respect to front, rear, right, left, up, and down directions in FIGS. 1 and 2.

Figure 1:
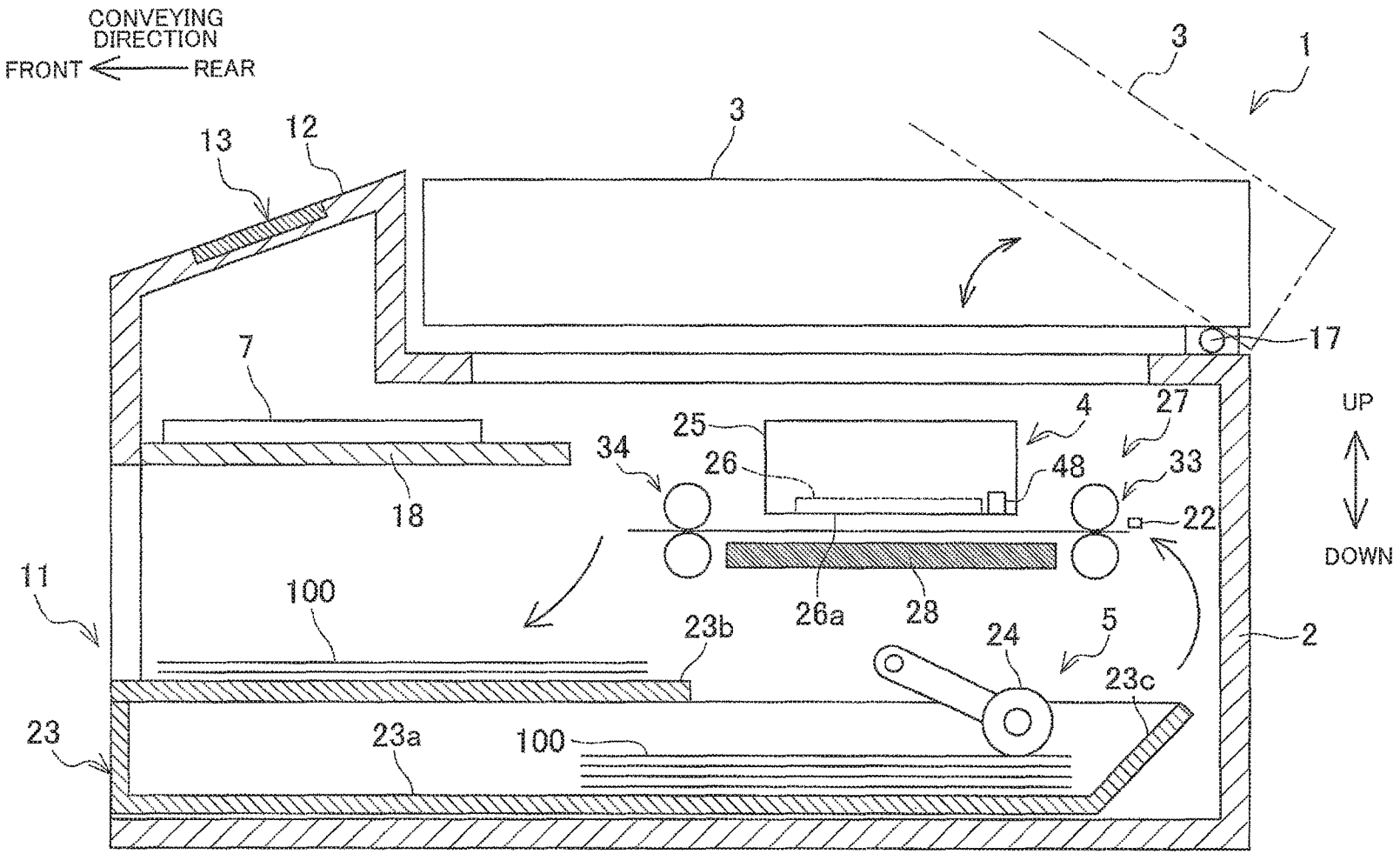
FIG. 1 is a cross-sectional view in vertical section schematically illustrating an internal structure of a printer.
Figure 2:
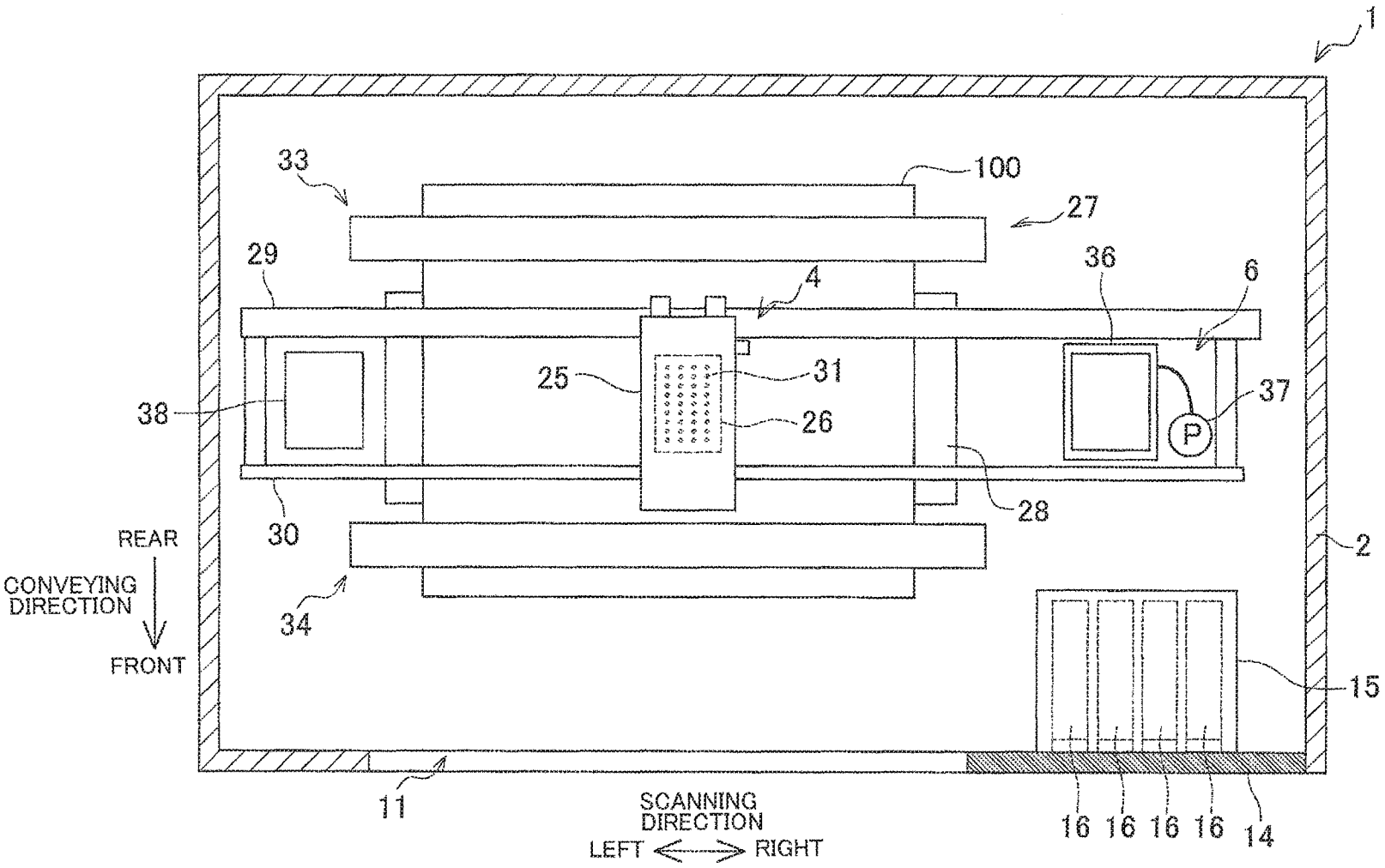
FIG. 2 is a plan view of an interior of the printer.

First, a configuration of the ink-jet printer 1 will be explained. As illustrated in FIGS. 1 and 2, the ink-jet printer 1 includes a printer housing 2 and a cover 3 pivotably mounted on the printer housing 2.

Printer Housing

As illustrated in FIGS. 1 and 2, the printer housing 2 contains a printing device 4, a sheet supplier 5, a maintenance device 6, and a control board 7, for example.

As illustrated in FIGS. 1 and 2, a front wall of the printer housing 2 has an opening 11. A sheet-supply cassette 23 of the sheet supplier 5 is mountable in a lower portion of the opening 11. An inclined surface 12 inclined frontward is provided on an upper portion of a front portion of the printer housing 2. An operation panel 13 is disposed on the inclined surface 12. This operation panel 13 includes a display panel and operation buttons, for example. The front wall of the printer housing 2 is provided with an opening and closing cover 14 located to the right of the opening 11. A holder 15 is disposed at the rear of the opening and closing cover 14. The holder 15 removably holds four ink cartridges 16 for storing ink of four colors, namely, black, yellow, cyan, and magenta. The printer housing 2 includes a board supporter 18 extending horizontally from an inner surface of the front wall. This board supporter 18 supports the control board 7 in which various circuits including a controller 40 (see FIG. 3) of the printer 1 are integrated.

Cover

The cover 3 is disposed at the rear of the inclined surface 12 of the printer housing 2. The cover 3 is mounted on the printer housing 2 so as to be pivotable in the up and down direction about a pivot shaft 17. The cover 3 is movable between a closed position, indicated by the solid line in FIG. 1, at which the cover 3 extends horizontally and an open position, indicated by the two-dot chain line in FIG. 1, at which the cover 3 is swung upward from the closed position. A scanner 19 (see FIG. 3) for reading an image formed on a document is provided on the cover 3. A detailed explanation of the scanner 19 is omitted.

Sheet Supplier

As illustrated in FIG. 1, the sheet supplier 5 includes: the sheet-supply cassette 23 mountable in the opening 11 of the printer housing 2; and a pickup roller 24 for picking up a recording sheet 100 from the sheet-supply cassette 23. The sheet-supply cassette 23 includes a main tray 23*a* and a sheet-discharge tray 23*b*. The main tray 23*a* is capable of supporting a plurality of the recording sheets 100. The sheet-discharge tray 23*b* is disposed over the main tray 23*a*. The printing sheet 100 on which an image has been recorded by the printing device 4 which will be described below is discharged onto the sheet-discharge tray 23*b*.

The pickup roller 24 is disposed on an upper side of the main tray 23*a* and pivotable about a pivot shaft provided on the printer housing 2. The pickup roller 24 is driven by a sheet-supply motor 20 (see FIG. 3) to pick up the recording sheets 100 one by one from the main tray 23*a* of the sheet-supply cassette 23.

The recording sheet 100 picked up by the pickup roller 24 is conveyed upward along an inclined surface 23*c* of a distal end portion of the sheet-supply cassette 23 and supplied to the printing device 4. A register sensor 22 is provided on a supply path extending from the main tray 23*a* to the printing device 4 provided above the main tray 23*a*, more specifically, the register sensor 22 is provided at a position P1 near a conveying roller 33 of a conveying mechanism 27 which will be described below. This register sensor 22 detects the recording sheet 100 supplied to the position P1 near the conveying roller 33 (see FIG. 8A). After the recording sheet 100 is supplied to the position P1 by the sheet supplier 5, the recording sheet 100 is conveyed by the conveying roller 33 to a printing start position (recording start position) P2 at which image recording is started.

Printing Device

The printing device 4 is disposed over the sheet supplier 5. As illustrated in FIGS. 1 and 2, the printing device 4 includes: a carriage 25 reciprocable in the right and left direction (hereinafter may be referred to as "scanning direction"); an ink-jet head 26 mounted on the carriage 25; and the conveying mechanism 27 that conveys the recording sheet 100 along a horizontal plane in the front direction (noted that this direction may be hereinafter referred to as "conveying direction").

A platen 28 for supporting the recording sheet 100 is disposed horizontally in the printer housing 2. As illustrated in FIG. 2, two guide rails 29, 30 are provided above the platen 28. These guide rails 29, 30 extend in a direction parallel with the scanning direction. The carriage 25 is driven by a carriage drive motor 32 (see FIG. 3) and thereby moved along the two guide rails 29, 30 in the scanning direction at an area opposed to the recording sheet 100 supported on the platen 28.

The ink-jet head 26 is mounted on the carriage 25, with a space formed between the ink-jet head 26 and the platen 28. A lower surface of the ink-jet head 26 is an ink ejection surface 26*a* having a multiplicity of nozzles 31. As illustrated in FIG. 2, the nozzles 31 are arranged in the conveying direction in four rows respectively corresponding to the four colors (black, yellow, cyan, and magenta) of the ink. The ink-jet head 26 is coupled to the holder 15 by four tubes, not illustrated. With this construction, the four colors of the ink stored in the four ink cartridges 16 held in the holder 15 is supplied to the ink-jet head 26 via the respective four tubes.

The ink-jet head 26 includes a multiplicity of driving elements 47 (see FIG. 3) each for applying energy to the ink in a corresponding one of the nozzles 31; and a driver IC 35 (see FIG. 3) for driving the driving elements 47. Any suitable elements may be employed as the driving elements 47. Examples of the driving elements 47 include piezoelectric elements and heating elements for heating the ink to cause film boiling. The driver IC 35 supplies drive signals, each having a particular waveform, respectively to the driving elements 47 to drive the driving elements 47.

A media sensor 48 is provided on a right surface of a rear end portion of the carriage 25. Any suitable sensor may be employed for the media sensor 48. One examples of the media sensor 48 is an optical sensor. In detection movement (which will be described below) which is performed just before printing, the media sensor 48 detects the recording sheet 100 supplied to the printing start position P2 (see FIG. 8B), while being moved in the scanning direction with the carriage 25.

As illustrated in FIG. 2, the carriage 25 is movable not only to the area opposed to the recording sheet 100 supported on the platen 28 but also to areas located on opposite sides of the opposed area in the right and left direction. The maintenance device 6 which will be described below is disposed to the right of the opposed area. A flushing receiver 38 is disposed to the left of the opposed area. In a state in which the ink-jet head 26 is opposed to the flushing receiver 38, the ink-jet head 26 ejects the ink out of the nozzles 31 to discharge the ink whose viscosity has been increased in the nozzles 31. This ink ejection is performed independently of the ink ejection for printing and will be hereinafter referred to as "flushing".

The conveying mechanism 27 includes the conveying roller 33 and a conveying roller 34 arranged with the platen 28 and the carriage 25 interposed therebetween. The conveying roller 33 is disposed at the rear of the platen 28 and the carriage 25. The conveying roller 34 is disposed in front of the platen 28 and the carriage 25. The two conveying rollers 33, 34 are rotated by a conveying motor 21 (see FIG. 3) in conjunction with each other. Just before printing performed by the ink-jet head 26, the conveying mechanism 27 conveys the recording sheet 100 conveyed to the position P1 by the sheet supplier 5, to the printing start position P2 located in front of the position P1 (see FIG. 8B). During printing performed by the ink-jet head 26, the conveying mechanism 27 conveys the recording sheet 100 frontward, i.e., in the conveying direction between the ink-jet head 26 and the platen 28.

Maintenance Device

The maintenance device 6 includes a cap member 36, a cap drive motor 39 (see FIG. 3), and a suction pump 37. The cap member 36 is moved in the up and down direction by the cap drive motor 39 and can be in close contact with the ink ejection surface 26*a* of the ink-jet head 26. That is, the maintenance device 6 switches a state of the ink-jet head 26 between a capped state in which the nozzles 31 are covered with the cap member 36 and an uncapped state in which the nozzles 31 are not covered with the cap member 36 so as to communicate with and be exposed to ambient air (see FIGS. 4A and 4B). In other words, the maintenance device 6 is switched between a capping state corresponding to the capped state and an uncapping state corresponding to the uncapped state.

The suction pump 37 is connected to the cap member 36. When the ink-jet head 26 is in the capped state, the suction pump 37 depressurizes a space defined by the cap member 36 to force the ink from the nozzles 31 into the cap member 36. In general, this ink discharging operation is referred to as "suction purging". This suction purging can discharge air bubbles and dust contained in the ink and/or high-viscosity ink, for example.

Controller

Figure 3:
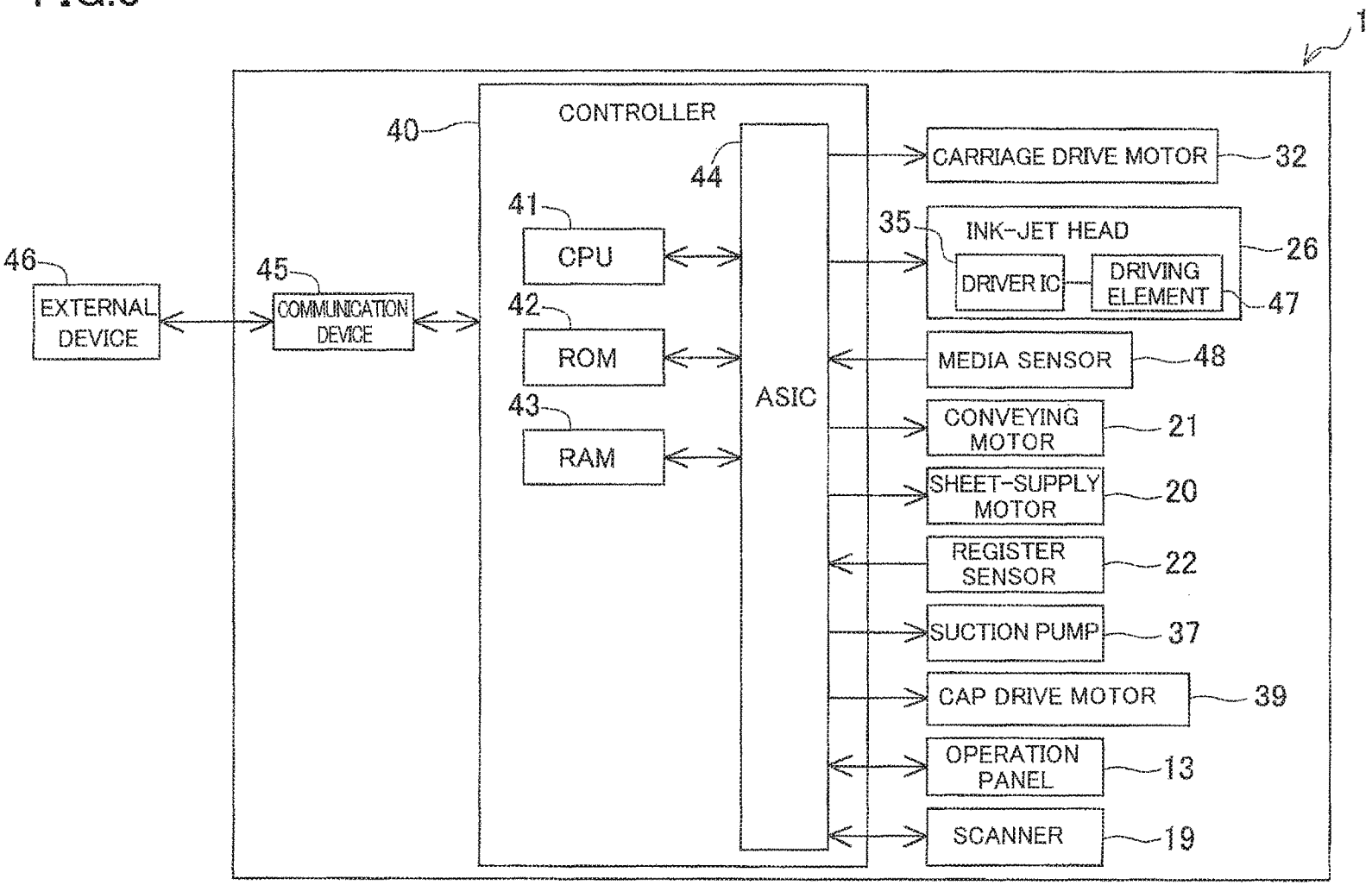
FIG. 3 is a block diagram illustrating an electric configuration of the printer.

The controller 40 is integrated in the control board 7 to control the devices and components of the printer 1. As illustrated in FIG. 3, the controller 40 includes a central processing unit (CPU) 41, a read only memory (ROM) 42, a random access memory (RAM) 43, and an application specific integrated circuit (ASIC) 44 including various kinds of control circuits. Devices electrically connected to the control board 7 include the scanner 19, the sheet-supply motor 20 of the sheet supplier 5, the ink-jet head 26 of the printing device 4, the carriage drive motor 32, the conveying motor 21, the suction pump 37 of the maintenance device 6, and the operation panel 13. Also, the control board 7 is electrically connected to an external device 46 such as a personal computer (PC) via a communication device 45. Image data for printing is input from the external device 46 to the controller 40. The ROM 42 stores various kinds of programs and data for execution of these programs. The CPU 41 executes the programs stored in the ROM 42, whereby the ASIC 44 executes processings for controlling operations of the sheet supplier 5, the printing device 4, and the maintenance device 6, for example.

For example, the controller 40 executes the following processings to print an image on the recording sheet 100. When an instruction for image printing is input from the operation panel 13 or the external device 46 such as the PC, the controller 40 controls the sheet-supply motor 20 to drive the pickup roller 24 to supply the recording sheet 100 placed on the main tray 23*a* to the printing device 4. The controller 40 controls the conveying motor 21 of the printing device 4 to convey the recording sheet 100 in the conveying direction. The controller 100 also controls the ink-jet head 26 to eject the ink onto the recording sheet 100 while controlling the carriage drive motor 32 of the printing device 4 to reciprocate the ink-jet head 26 in the scanning direction. As a result, an image is printed on the recording sheet 100. Also, the controller 40 controls the cap drive motor 39 of the maintenance device 6 to elevate and lower the cap member 36 and controls the suction pump 37 of the maintenance device 6 to perform the suction purging, for example.

In the above-described explanation, the controller 40 executes the processings by cooperation of the CPU and the ASIC, but the controller may include a plurality of CPUs that may execute the processings by dividing the processings among the CPUs. Also, the controller may include a plurality of ASICs that may execute the processings by dividing the processings among the ASICs. Alternatively, a single ASIC may execute the processings alone.

There will be next explained, with reference to FIGS. 4A-7, a series of processings executed by the controller 40 in a printing preparing period before an image is printed on the recording sheet 100.

Figure 4A:
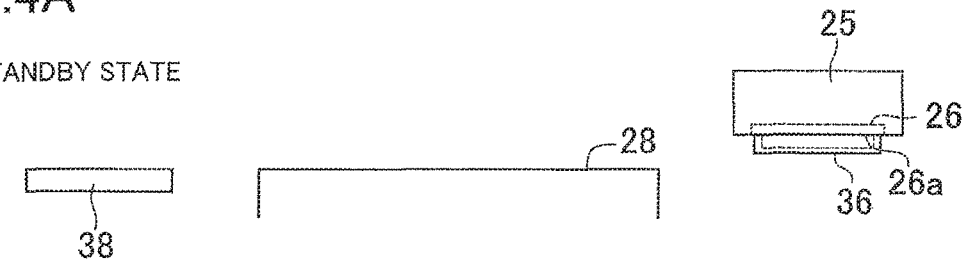
FIGS. 4A through 4D are views for explaining operations of the printer in a first portion of a printing preparing period.
Figure 4B:
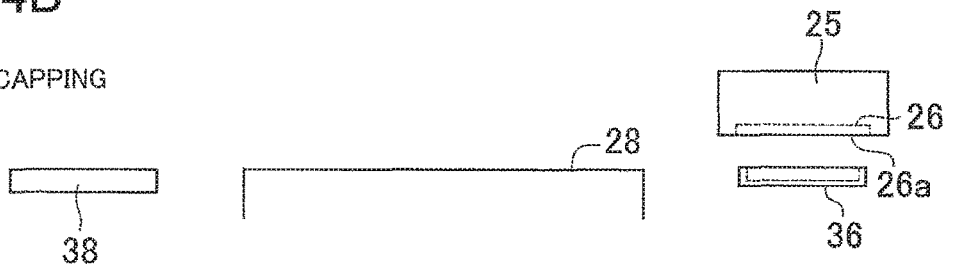

In a standby state in which no printing is performed on the recording sheet 100, as illustrated in FIG. 4A, the ink-jet head 26 is located to the right of the platen 28, and the cap member 36 is held in close contact with the ink ejection surface 26*a*. That is, the ink-jet head 26 is in the capped state in which the nozzles 31 are covered with the cap member 36. When a print instruction is input from the external device 46 or the operation panel 13 in this state (S1: Yes), as illustrated in FIG. 4B, the controller 40 controls the cap drive motor 39 to lower the cap member 36. As a result, the cap member 36 is separated from the ink ejection surface 26*a*, so that the ink-jet head 26 is at S2 in the uncapped state in which the nozzles 31 communicates with ambient air.

As explained later, the controller 40 measures a length of time elapsed from the input of the print instruction to detection of the recording sheet 100 by the register sensor 22. In the present embodiment, in particular, the controller 40 at S3 starts measuring an elapsed time T when the ink-jet head 26 is switched to the uncapped state. Use of the elapsed time T will be explained later.

Incidentally, in a period from the end of the preceding printing to an input of the latest print instruction, the ink in each of the nozzles 31 dries gradually and the viscosity of the ink increases although the ink-jet head 26 is waiting in the capped state as illustrated in FIG. 4A. To solve this problem, before printing on the recording sheet 100, the controller 40 controls the ink-jet head 26 to perform the flushing as first preparatory driving for eliminating the increased viscosity of the ink in each of the nozzles 31.

Figure 4C:
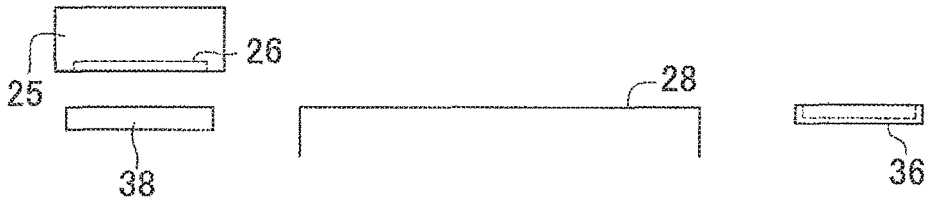
Figure 4D:
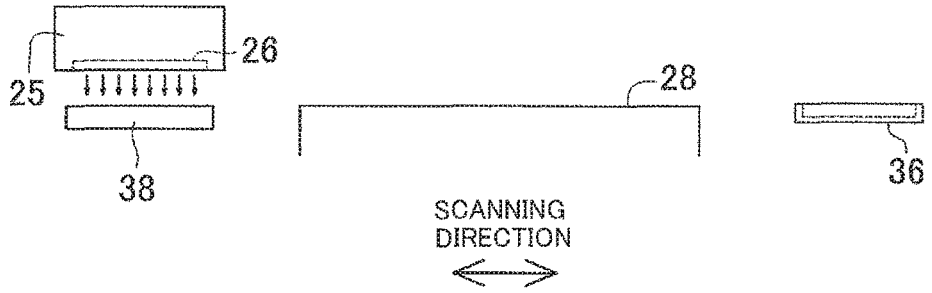

As a preparation for the flushing, as illustrated in FIG. 4C, the controller 40 at S4 controls the carriage drive motor 32 to move the ink-jet head 26 to a position that is located to the left of the platen 28 and that is opposed to the flushing receiver 38. This position may be hereinafter referred to as "reference position" for the carriage 25 (the ink-jet head 26). In the state in which the carriage 25 is located at the reference position, as illustrated in FIG. 4D, the controller 40 at S5 controls the driver IC 35 of the ink-jet head 26 to drive the driving elements 47 to cause the ink-jet head 26 to perform flushing from the nozzles 31 onto the flushing receiver 38. In this flushing, the ink whose viscosity has been increased in the nozzles 31 is discharged in the head standby period extending from the end of the preceding printing to the input of the latest print instruction.

The controller 40 at S6 controls the sheet supplier 5 to start supplying the recording sheet 100 in parallel with the flushing.

Figure 8A:
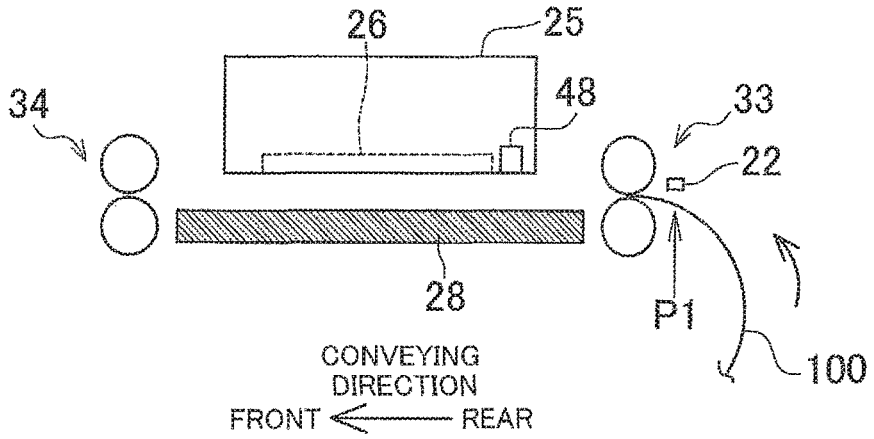
FIG. 8A is a view illustrating detection of a recording sheet by a register sensor.

The controller 40 first controls the sheet-supply motor 20 to rotate the pickup roller 24. The pickup roller 24 picks up an uppermost one of the recording sheets 100 placed on the main tray 23*a*, and the recording sheet 100 is supplied to the ink-jet head 26. When the recording sheet 100 is detected by the register sensor 22 at the position P1 on the supply path as illustrated in FIG. 8A (S7: Yes), the controller 40 controls the pickup roller 24 to stop supplying the sheet.

Here, the controller 40 starts the measurement of the elapsed time T when the ink-jet head 26 is switched to the uncapped state (S3) as described above, and the controller 40 at S8 stops this measurement of the elapsed time T when the recording sheet 100 is detected by the register sensor 22. That is, the elapsed time T is a time elapsed from the switch of the ink-jet head 26 to the uncapped state, to the detection of the recording sheet 100 by the register sensor 22. This elapsed time T is used for control of second preparatory driving, which will be explained later, for eliminating the increased viscosity of the ink.

Figure 8B:
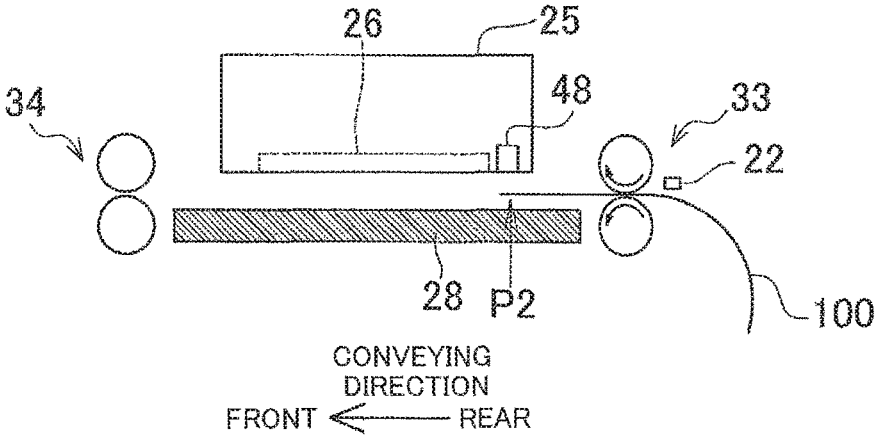
FIG. 8B is a view illustrating detection of the recording sheet by a media sensor.

As illustrated in FIG. 8B, the controller 40 at S9 controls the conveying motor 21 to rotate the conveying roller 33 to convey the recording sheet 100 conveyed to the position P1, to the printing start position P2. The operation for conveying the recording sheet 100 to the printing start position P2 after the detection by the register sensor 22 may be referred to as "leading edge positioning".

Figure 5A:
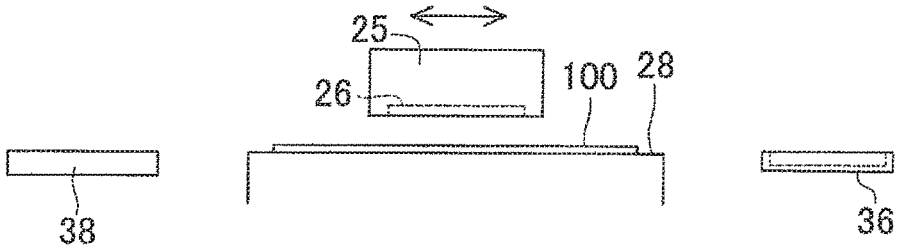
FIGS. 5A through 5D are views for explaining operations of the printer in a latter portion of the printing preparing period.
Figure 5B:
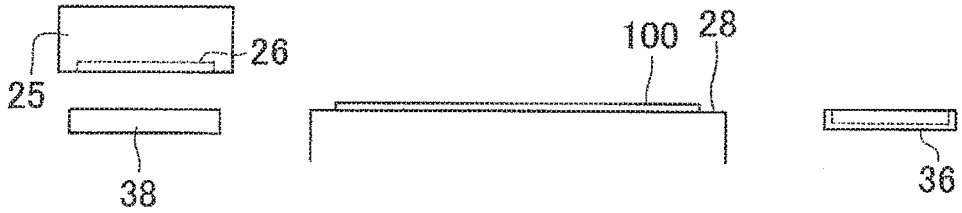
Figure 9:
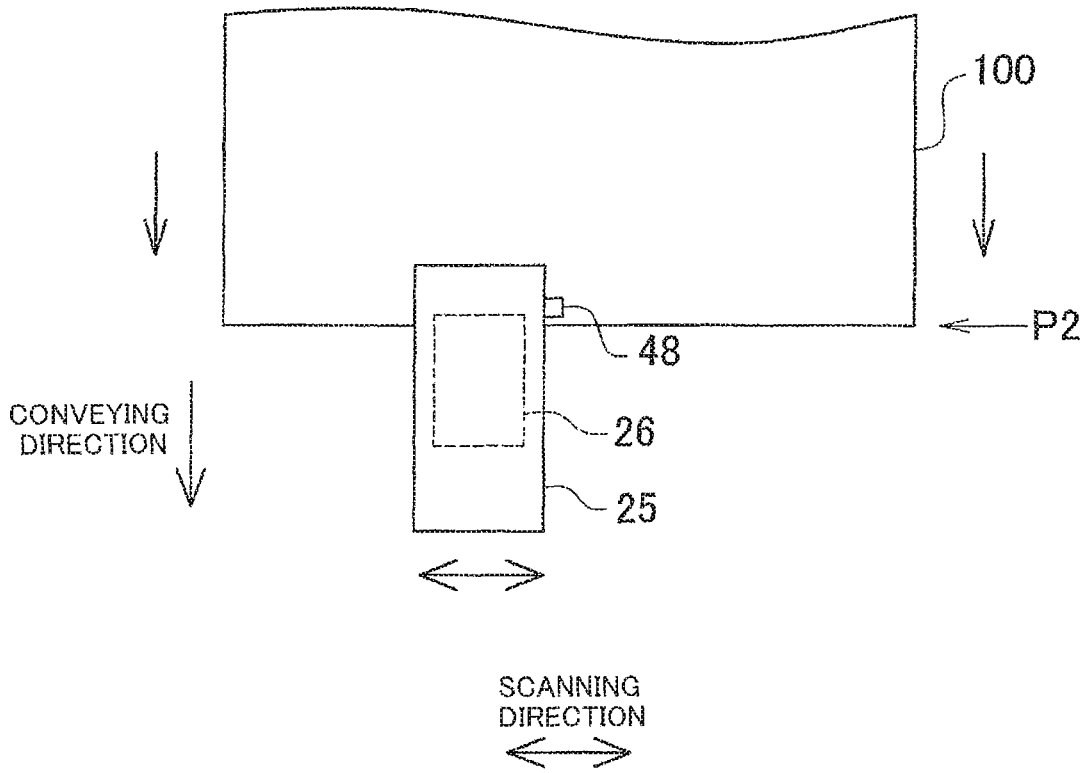
FIG. 9 is a plan view of a carriage in detection movement.

The controller 40 then controls the media sensor 48 to detect the recording sheet 100 located at the printing start position P2. That is, as illustrated in FIGS. 5A and 9, simultaneously with the conveyance of the recording sheet 100 to the printing start position P2, the controller 40 at S10 controls the carriage drive motor 32 to move the carriage 25 in the scanning direction intersecting a direction in which the recording sheet 100 is supplied. This reciprocation may be hereinafter referred to as "detection movement". In this detection movement, when the recording sheet 100 conveyed to the printing start position P2 is detected by the media sensor 48 (S11: YES), as illustrated in FIG. 5B, the controller 40 at S12 temporarily moves the carriage 25 to the reference position located to the left of the platen 28, as a preparation for printing on the recording sheet 100.

Figure 5C:
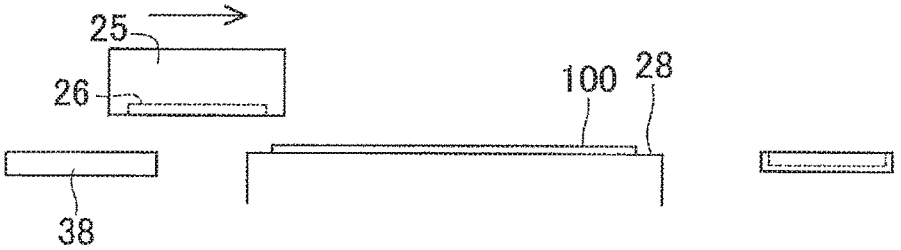
Figure 5D:
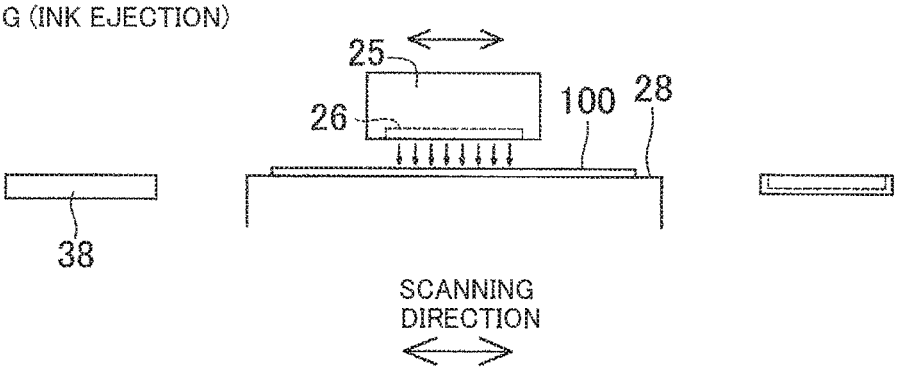

As illustrated in FIG. 5C, the controller 40 at S13 moves the carriage 25 from the reference position in the scanning direction again to cause the ink-jet head 26 to perform printing (printing movement). As illustrated in FIG. 5D, the controller 40 at S14 controls the ink-jet head 26, while reciprocating the carriage 25, to start ejecting the ink from the nozzles 31 to print an image on the recording sheet 100.

Figure 7:
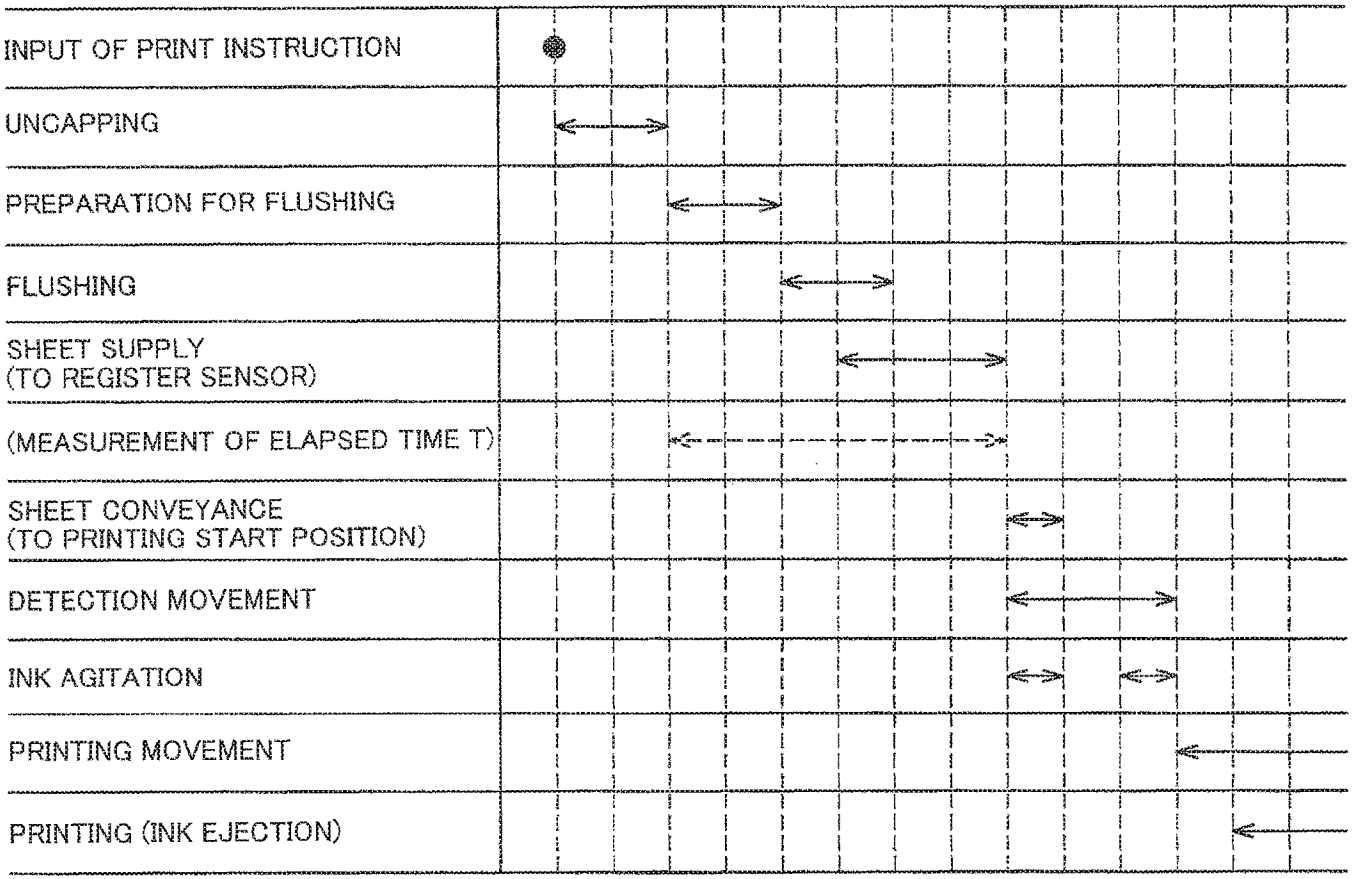
FIG. 7 is a view illustrating timings and periods of operations of the printer in the printing preparing period in normal sheet supply.

Incidentally, the flushing (S5) in FIG. 4D eliminates the increased viscosity of the ink in the nozzles 31 which is caused during standby of the ink-jet head 26 in the capped state as illustrated in FIG. 4A. However, independently of this case, the viscosity of the ink in the nozzles 31 increases also during a period from the establishment of the uncapped state of the ink-jet head 26 to the start of the printing on the recording sheet 100. To solve this problem, as illustrated in FIG. 7, the controller 40 controls the driving elements 47 of the ink-jet head 26 during the detection movement (S10) to perform ink agitation driving as the second preparatory driving for eliminating the increased viscosity of the ink in each of the nozzles 31.

In the ink agitation driving, the driving elements 47 apply small energy to the ink when compared with the case where the ink is ejected from the nozzles 31, whereby the ink in the nozzles 31 is agitated without ejection of the ink. Specifically, the driver IC 35 (see FIG. 3) sends each of the driving elements 47 a drive signal different from that used for ink ejection, to cause a pressure wave in the ink such that the ink is not ejected from the nozzle 31. This pressure wave slightly vibrates a meniscus of the ink in the nozzle 31, causing agitation of the ink in the nozzle 31. This ink agitation mixes the high-viscosity ink near an ejection opening of each nozzle 31 and low-viscosity ink present on an inner side of the high-viscosity ink, whereby the increased viscosity of the ink near the ejection opening is lowered.

A degree of increase in viscosity of the ink in the nozzles 31 due to the uncapped state of the ink-jet head 26 varies depending upon how long the uncapped state is continued. The length of time of the uncapped state may vary for the following reason. For example, when the recording sheet 100 is picked up from the main tray 23*a* by the pickup roller 24, a slip may be caused between the pickup roller 24 and the recording sheet 100. The pickup roller 24 slips for a certain length of time from the start of driving of the pickup roller 24, and accordingly a length of time required for the recording sheet 100 to actually reach the printing device 4 is long when compared with the case where no slip is caused.

In view of this situation, in the present embodiment, the controller 40 controls the ink agitation driving based on the length of time from the input of the print instruction. More specifically, the controller 40 increases the length of time of the ink agitation driving performed by the ink-jet head 26, with increase in the elapsed time T extending from the switch of the ink-jet head 26 to the uncapped state to the detection of the recording sheet 100 by the register sensor 22 (S3-S8).

The control of the ink agitation driving will be explained with a concrete example. The ROM 42 of the controller 40 illustrated in FIG. 3 stores two threshold values Ta, Tb (Ta <Tb) for the elapsed time T. When the elapsed time T is less than or equal to the threshold value Ta, the controller 40 determines that the sheet is supplied normally (normal sheet supply). When the elapsed time T is greater than the threshold value Ta and less than or equal to the threshold value Tb, the controller 40 determines that a short period slip is caused. When the elapsed time T is greater than the threshold value Tb, the controller 40 determines that a long period slip is caused. The ROM 42 stores information about a period of the ink agitation driving for each of the case of the normal sheet supply, the case where a short period slip is caused, and the case where a long period slip is caused.

Figure 10:
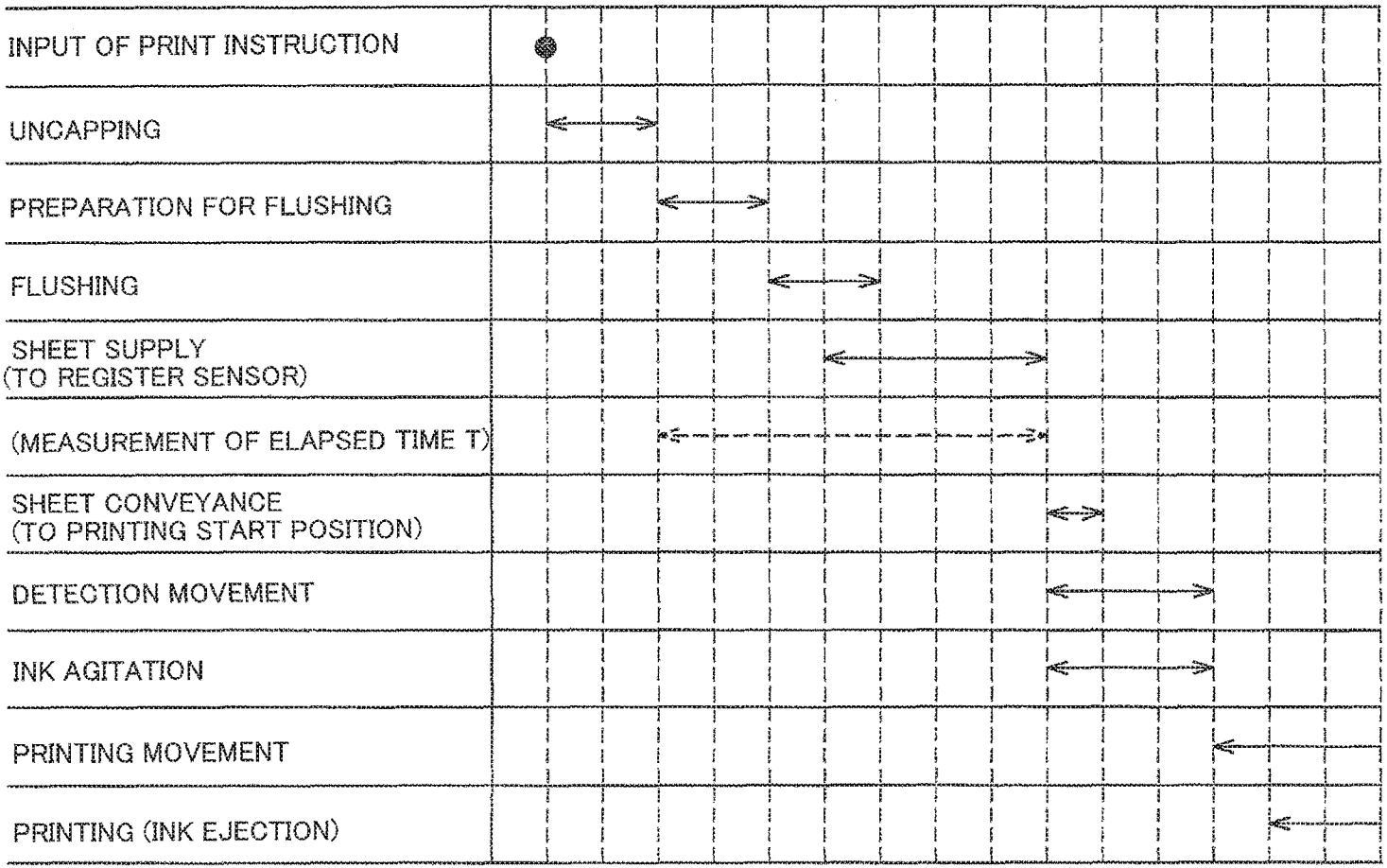
FIG. 10 is a view corresponding to FIG. 7 in the case where a short period slip is caused.
Figure 11:
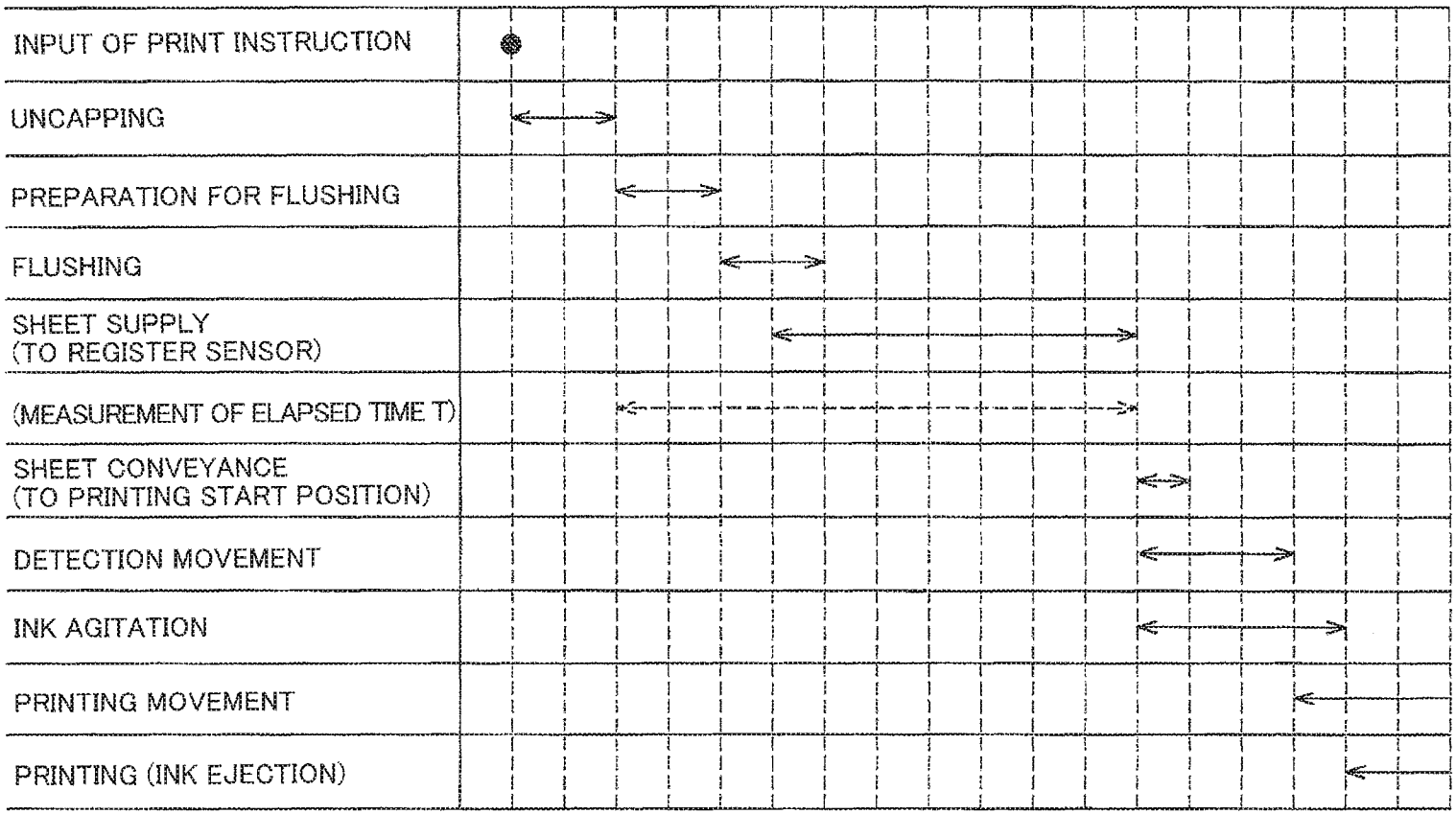
FIG. 11 is a view corresponding to FIG. 7 in the case where a long period slip is caused.

FIG. 7 illustrates the case of the normal sheet supply. FIG. 10 illustrates the case where a short period slip is caused. FIG. 11 illustrates the case where a long period slip is caused. As illustrated in FIG. 7, the viscosity of the ink in each nozzle 31 is not increased greatly in the normal sheet supply with a short elapsed time T. Thus, the controller 40 controls the ink-jet head 26 to perform the ink agitation driving only in a portion of a period of the detection movement.

As illustrated in FIG. 10, the elapsed time T is longer in the case where a short period slip is caused than in the case of the normal sheet supply in FIG. 7. Thus, the controller 40 controls the ink-jet head 26 to perform the ink agitation driving in the entire period of the detection movement.

As illustrated in FIG. 11, in the case where a long period slip is caused, a considerably long time is required for the recording sheet 100 to be supplied. Thus, the controller 40 continues the ink agitation driving not only in the detection movement but also in the printing movement. That is, the controller 40 controls the ink-jet head 26 to perform the ink agitation driving also during movement of the ink-jet head 26, in the printing movement, from the reference position to a position at which the ink-jet head 26 ejects the ink onto an edge portion of the recording sheet 100.

In the present embodiment, the controller 40 controls the ink-jet head 26 to perform the flushing as the first preparatory driving after the print instruction is input, and the ink-jet head 26 is switched to the uncapped state. When the supply of the recording sheet 100 is thereafter started, and the recording sheet 100 is detected by the register sensor 22, the controller 40 controls the ink-jet head 26 to perform the ink agitation driving as the second preparatory driving. Here, this ink agitation driving is performed in accordance with the elapsed time T extending to the detection of the recording sheet 100 by the register sensor 22. That is, the ink agitation driving can be appropriately performed even in the case where a relatively long time is required for the supply of the recording sheet 100 due to the slip of the pickup roller 24, for example. Specifically, in the present embodiment, the controller 40 increases the time of the ink agitation driving with increase in the elapsed time T. This configuration can effectively eliminate the increased viscosity of the ink in the nozzles 31.

In the present embodiment, the controller 40 measures the time from the switch of the ink-jet head 26 to the uncapped state in which the nozzles 31 communicate with air, to the detection of the recording sheet 100 by the register sensor 22, as the elapsed time T used for the control of the second preparatory driving. The increase in viscosity of the ink in this time is caused because the ink-jet head 26 is switched to the uncapped state, and the nozzles 31 communicate with air. Thus, the controller controls the second preparatory driving based on the time elapsed after the uncapped state is established. This configuration can more effectively eliminate the increased viscosity of the ink in the nozzles 31.

Also, the controller 40 controls the ink-jet head 26 to perform the ink agitation driving (the second preparatory driving) while the recording sheet 100 is being conveyed to the printing start position P2 by the conveying roller 33 after the recording sheet 100 is detected by the register sensor 22. That is, in the present embodiment, not only the flushing (the first preparatory driving) but also the ink agitation driving (the second preparatory driving) is performed before printing. However, the printing preparing period is not long because the ink agitation driving and the leading edge positioning for the recording sheet are performed at the same time.

Also, the detection movement of the carriage 25 is performed after the recording sheet 100 is detected by the register sensor 22. In this detection movement, the media sensor 48 detects whether the recording sheet 100 is supplied to the printing start position P2. Here, in the present embodiment, the controller 40 controls the ink-jet head 26 to perform the ink agitation driving during the detection movement of the carriage 25. That is, in the present embodiment, not only the flushing (the first preparatory driving) but also the ink agitation driving (the second preparatory driving) is performed before printing, but the printing preparing period does not become longer because the ink agitation driving and the detection movement are performed at the same time.

In the present embodiment, the second preparatory driving performed simultaneously with the detection movement is the ink agitation driving that does not cause ink ejection unlike the flushing. Thus, even when the ink-jet head 26 performs the second preparatory driving in the detection movement, the ink does not adhere to the recording sheet 100.

In the present embodiment, when the recording sheet 100 is supplied to the printing start position P2, the controller 40 controls the carriage 25 to temporarily move to the reference position. The controller 40 then controls the carriage 25 to start moving from the reference position again (the printing movement) and controls the ink-jet head 26 to perform printing. In the printing movement, when the elapsed time T is long, the controller 40 controls the ink-jet head 26 to perform the ink agitation driving also during the period from the start of movement of the carriage 25 from the reference position to the ink ejection from the nozzles 31. That is, since the ink agitation driving is performed just before the ink ejection onto the recording sheet 100, it is possible to reliably prevent the increase in viscosity of the ink in the nozzles 31.

In the embodiment described above, the ink-jet printer 1 is one example of an image recording apparatus. The recording sheet 100 is one example of a recording medium. Each of the sheet supplier 5 and the conveying roller 33 are one example of a medium supplier that supplies the recording sheet 100 to the printing start position P2. Each of the driving elements 47 is one example of an energy applier. The register sensor 22 is one example of a first sensor. The media sensor 48 is one example of a second sensor. The maintenance device 6 is one example of a capping device.

While the embodiment has been described above, it is to be understood that the disclosure is not limited to the details of the illustrated embodiment, but may be embodied with various changes and modifications, which may occur to those skilled in the art, without departing from the spirit and scope of the disclosure. It is noted that the same reference numerals as used in the above-described embodiment are used to designate the corresponding elements of the following modifications, and an explanation of which is dispensed with.

First Modification

Figure 12:
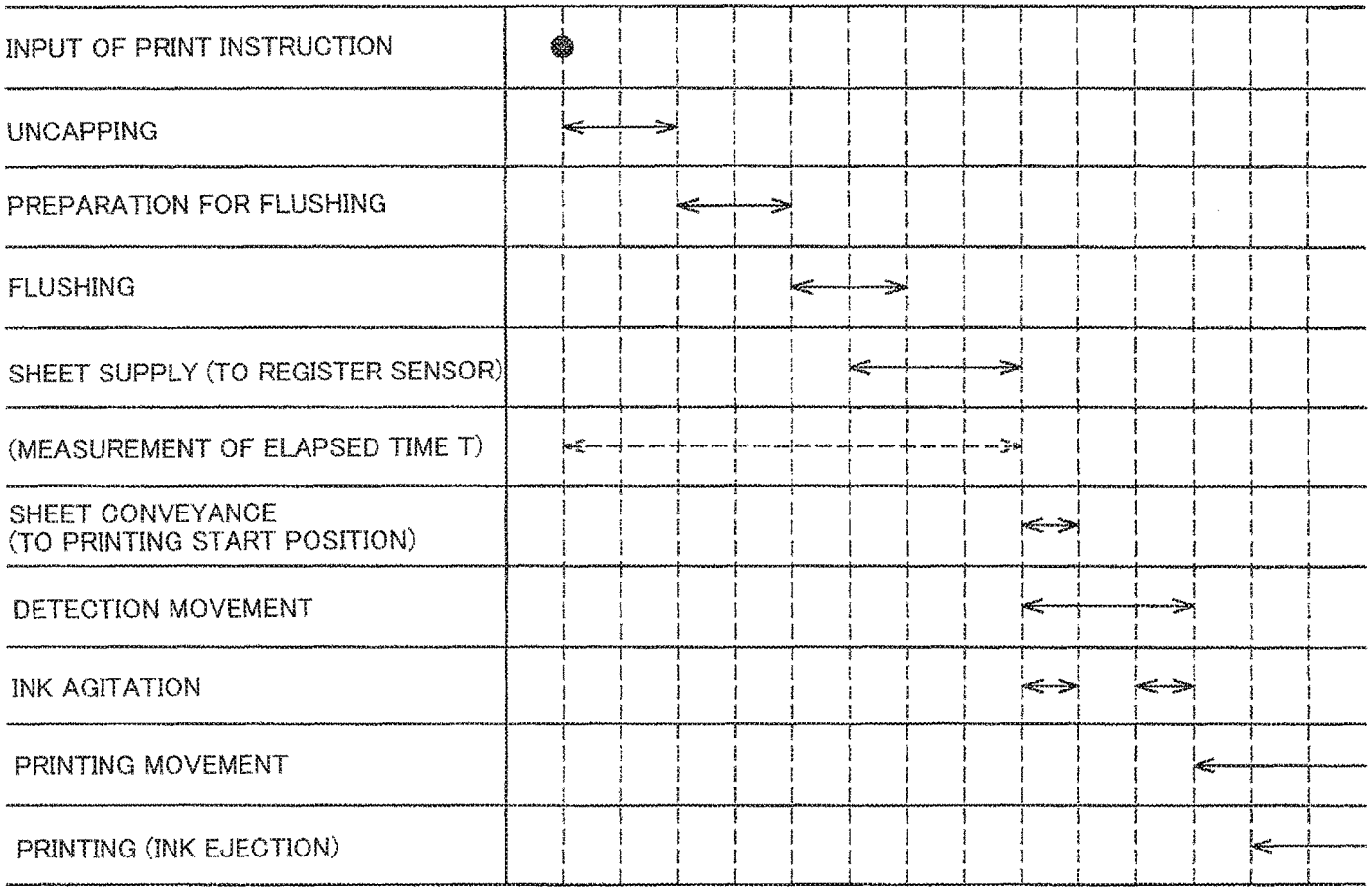
FIG. 12 is a view illustrating timings and periods of operations of the printer in the printing preparing period in a modification.

In the above-described embodiment, the length of time after the ink-jet head 26 is switched to the uncapped state is measured as the elapsed time T used for the control of the ink agitation driving (the second preparatory driving). In a first modification, as illustrated in FIG. 12, a length of time from the input of the print instruction to the detection of the recording sheet 100 by the register sensor 22 may be measured as the elapsed time T.

Second Modification

Figure 6:
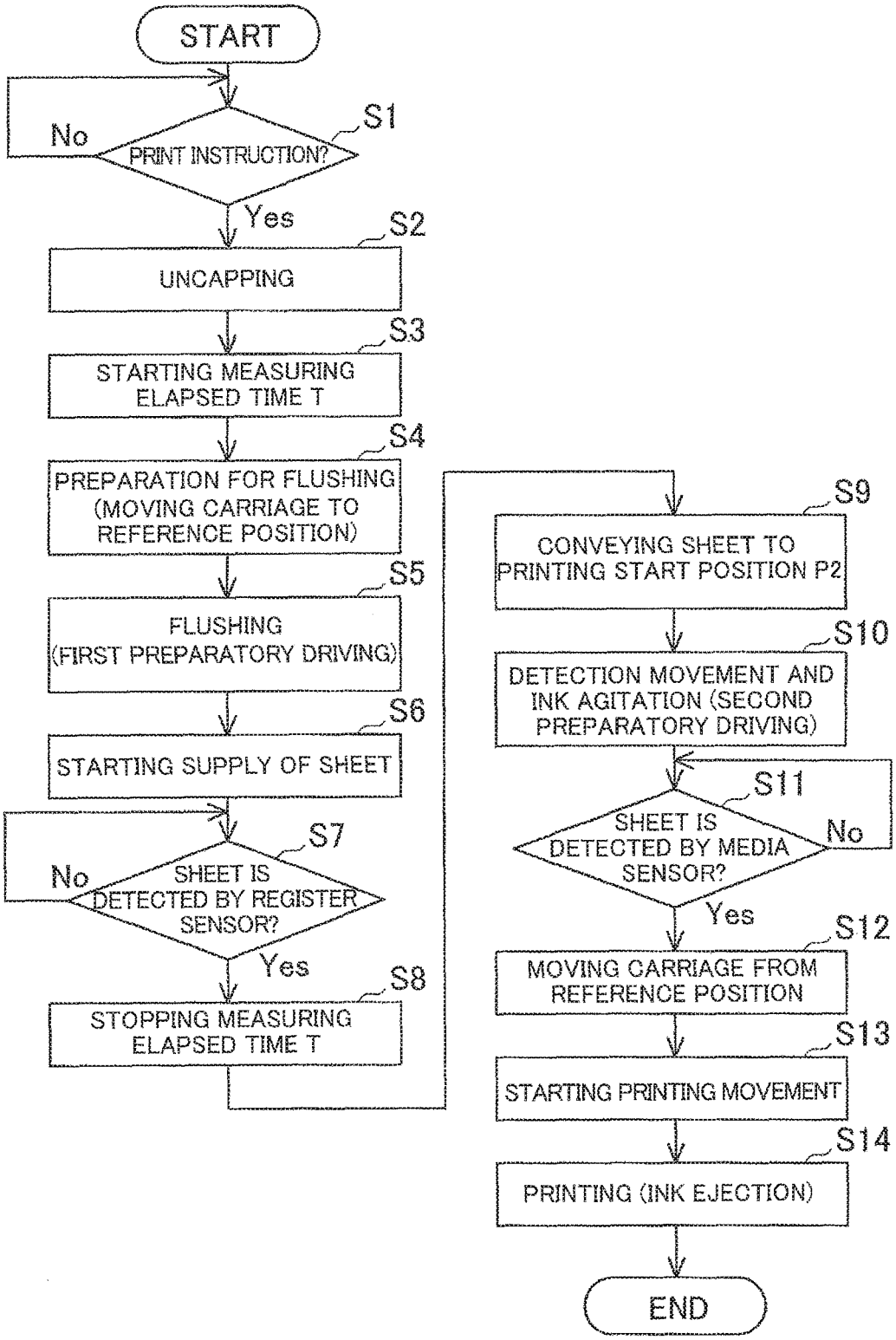
FIG. 6 is a flow chart illustrating operations of the printer in the printing preparing period.
Figure 13:
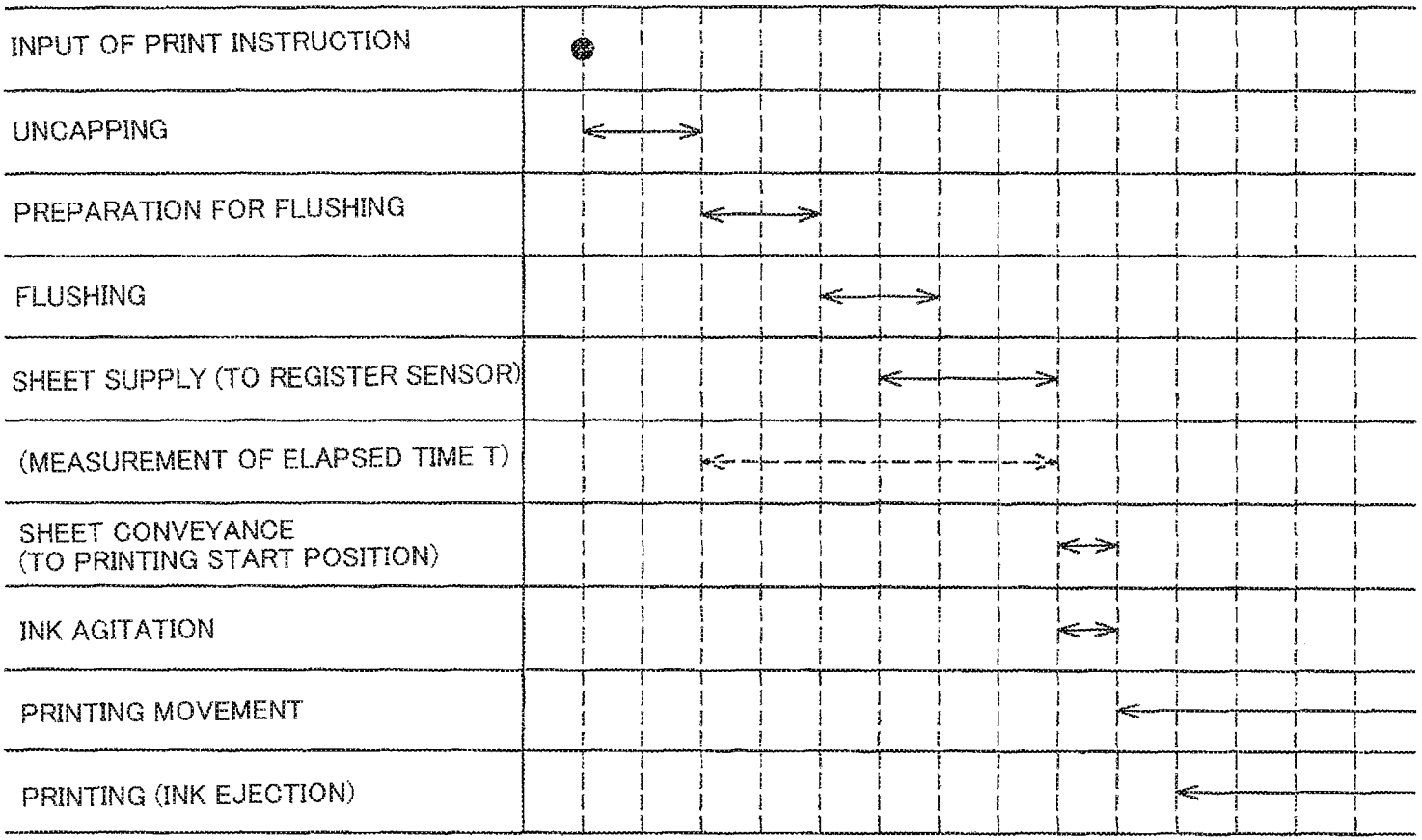
FIG. 13 is a view illustrating timings and periods of operations of the printer in the printing preparing period in another modification.

In the above-described embodiment, when the recording sheet 100 is conveyed to the printing start position P2 by the conveying roller 33, the controller 40 simultaneously controls the carriage 25 to perform the detection movement in which the media sensor 48 detects that the recording sheet 100 reaches the printing start position P2 (S10 in FIG. 6). In a second modification, as illustrated in FIG. 13, the detection movement of the carriage 25 and the detection of the recording sheet 100 by the media sensor 48 can be omitted. That is, when the recording sheet 100 is detected by the register sensor 22, the controller 40 controls the conveying roller 33 to convey the recording sheet 100 by a particular amount to position the recording sheet 100 at the printing start position P2. It is noted that, as in the above-described embodiment, the controller 40 controls the ink-jet head 26 to perform the ink agitation driving in the conveyance of the recording sheet 100 by the conveying roller 33. In this modification, the printing preparing period can be reduced by a time required for the detection movement.

Third Modification

The second preparatory driving is the ink agitation driving in which no ink is ejected in the above-described embodiment but may be the flushing. In this modification, the controller 40 increases a total amount of ink discharged in the flushing, with increase in the elapsed time T. For example, the controller 40 increases the total amount of discharged ink by increasing the length of time of the flushing, increasing the number of ink discharges in the flushing, or increasing the size of each ink droplet discharged in the flushing.

In the case where the second preparatory driving is performed simultaneously with the detection movement, when the second preparatory driving is the flushing, the ink discharged from the nozzles 31 adheres to the recording sheet 100. Thus, an amount of the ink discharged in this flushing is preferably reduced to make the ink inconspicuous even when the ink adheres to the recording sheet 100. For example, the amount of the ink discharged in the flushing as the second preparatory driving is made less than that in the flushing as the first preparatory driving (S5 in FIG. 6).

Also, the controller 40 may selectively control the ink-jet head 26 to perform any one of the flushing and the ink agitation driving as the second preparatory driving based on the length of the elapsed time T. For example, longer ink agitation driving more effectively lowers the increased viscosity of the ink, but if the ink agitation driving is kept performed too long, the ink is exposed to air more frequently, resulting in increase in viscosity of the ink on the contrary. To solve this problem, the controller 40 may select the flushing when the elapsed time T is longer than a specific time and select the ink agitation driving only when the elapsed time T is less than or equal to the specific time.

Fourth Modification

In the above-described embodiment, the controller 40 increases the length of time of the second preparatory driving with increase in the elapsed time T but may select whether the second preparatory driving is performed, based on the length of the elapsed time T. That is, when the elapsed time T is longer than a particular time T1, the controller 40 controls the ink-jet head 26 to perform the second preparatory driving as in the above-described embodiment. When the elapsed time T is less than or equal to the particular time T1, the controller 40 controls the ink-jet head 26 not to perform the second preparatory driving. This configuration eliminates unnecessary second preparatory driving. It is noted that this particular time T1is one example of a first time.

Fifth Modification

Figure 14A:
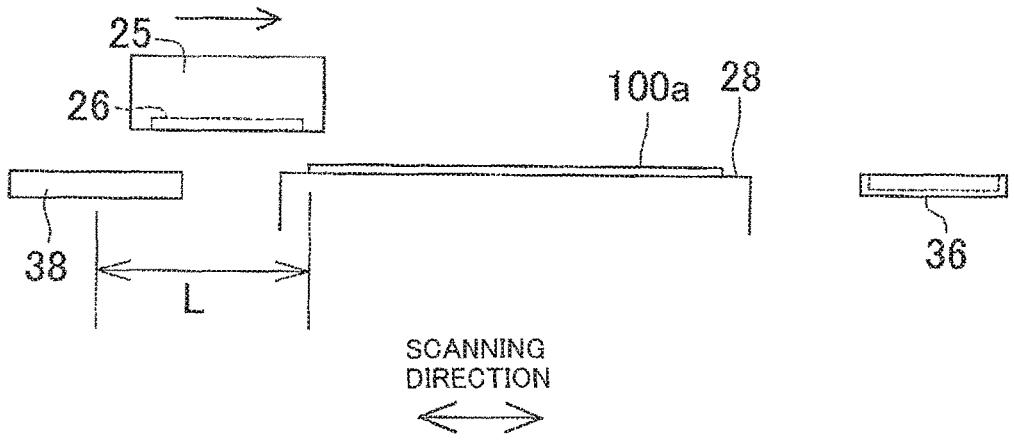
FIG. 14A is a view illustrating the printer in printing movement in another modification in the case where the width of the recording sheet is large.
Figure 14B:
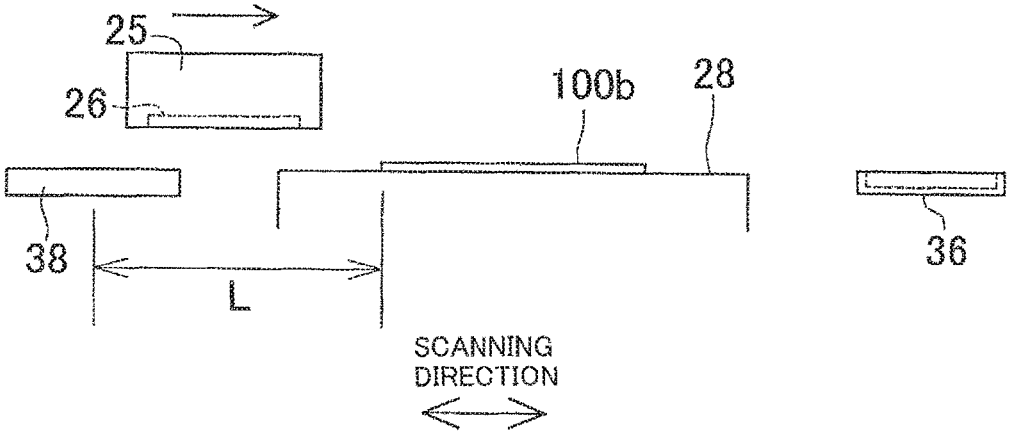
FIG. 14B is a view illustrating the printer in printing movement in the case where the width of the recording sheet is small.

In the above-described embodiment, when the elapsed time T is long, the controller 40 controls the ink-jet head 26 to perform the second preparatory driving in the printing movement at the start of printing until the time just before the ink is actually ejected onto the recording sheet 100 (see FIGS. 5C and 11). Here, in the case where the sheet supplier 5 can supply various sizes of the recording sheets 100 to the printing device 4, as illustrated in FIGS. 14A and 14B, a distance L between the reference position and an edge of each recording sheet 100 in the scanning direction varies among the recording sheets 100 having different widths in the scanning direction. That is, as illustrated in FIG. 14A, when a wide recording sheet 100*a* is supplied, the ink is ejected from the nozzles 31 just after the start of the printing movement of the carriage 25 from the reference position. On the other hand, as illustrated in FIG. 14B, when a narrow recording sheet 100*b* is supplied, the ink is ejected after a short length of time from the start of the printing movement. Here, from the viewpoint of reducing ejection failure due to the increase in viscosity of the ink, the second preparatory driving is preferably performed in the printing movement until the time just before the ink ejection for printing.

In this modification, the controller 40 may increase the length of time of the second preparatory driving with increase in the distance L between the reference position and the edge of the recording sheet 100 in the scanning direction. Specifically, information about the kind of the recording sheet 100 to be printed is first input to the controller 40 with the print instruction received from the external device 46 or the operation panel 13. Also, the ROM 42 of the controller 40 stores information about the size of each of the recording sheets 100 usable in the printer 1, specifically, the ROM 42 stores information about the width of each recording sheet 100 in the scanning direction, for example. The controller 40 obtains the distance L between the reference position and the edge of the recording sheet 100 in the scanning direction, based on the information about the kind of the recording sheet 100 which is input from, e.g., the external device 46 and the information about each sheet size which is stored in the ROM 42, and the controller 40 then sets the length of time of the second preparatory driving based on the distance L. With this configuration, the second preparatory driving can be performed until the time just before the ink ejection from the nozzles 31, regardless of the size of the recording sheet 100.

Sixth Modification

The flushing as the first preparatory driving which is performed just after the input of the print instruction is for discharging the ink whose viscosity has been increased in the nozzles 31 during the standby time extending from the end of the preceding printing to the input of the latest print instruction. Thus, the length of time of the flushing is preferably determined based on the standby time of the ink-jet head 26 which is a time period in which no printing is performed. However, in the case where the printer is not used for a long time, and the standby time is considerably long, if the length of time of the flushing is increased in accordance with the long standby time, the total time required for the preparation of printing is also increased greatly.

Figure 15:
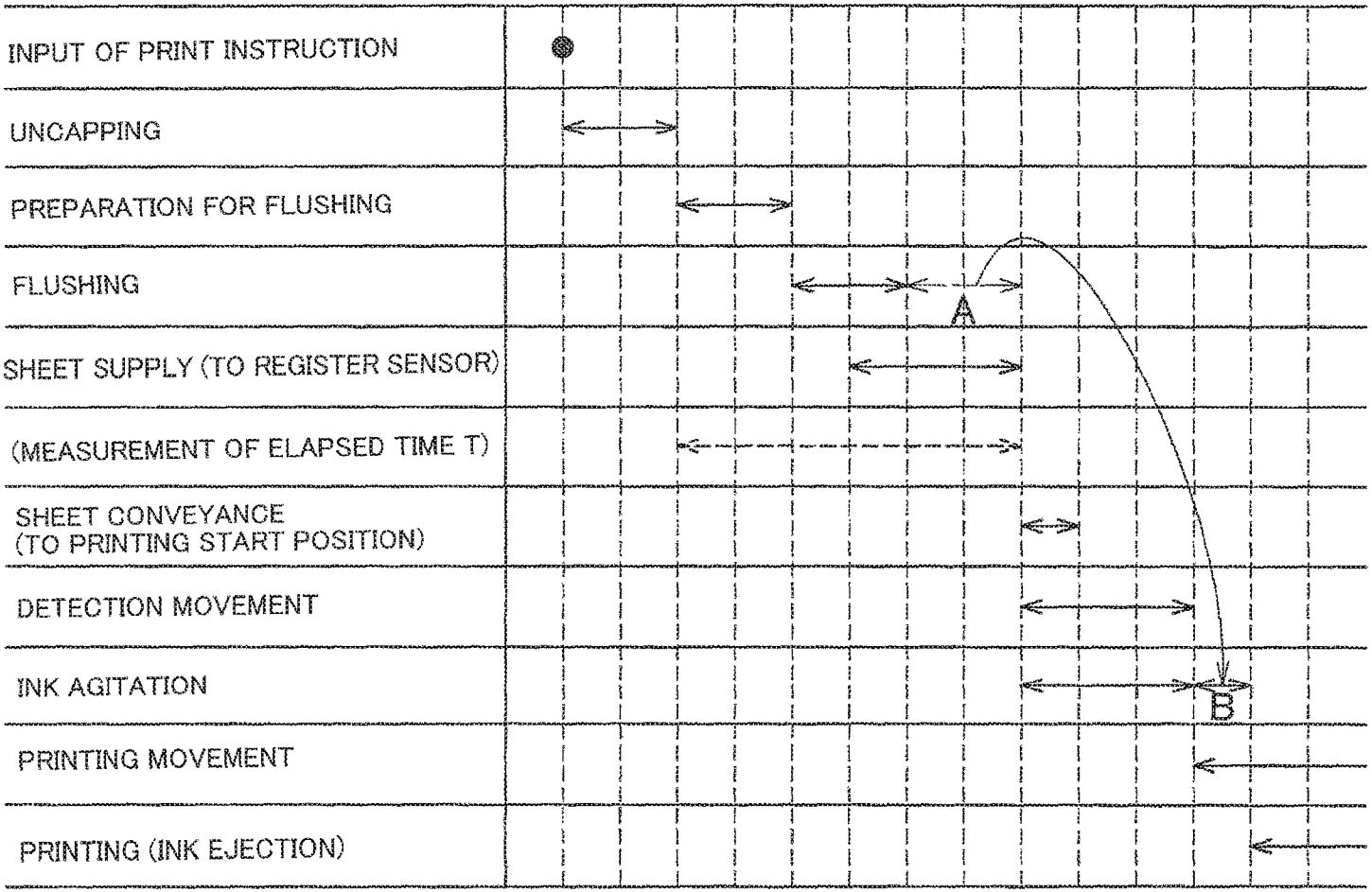
FIG. 15 is a view illustrating timings and periods of operations of the printer in the printing preparing period in another modification.

To solve this problem, as illustrated in FIG. 15, in the case where the standby time of the ink-jet head 26 is considerably long, the controller 40 may increase the length of time of the second preparatory driving. That is, when the standby time is less than or equal to a particular time T2, the controller 40 increases the length of time of the flushing (the first preparatory driving) with increase in the standby time. When the standby time is much longer than the time T2, as illustrated in FIG. 15, the controller 40 makes the length of time of the flushing constant regardless of the standby time without further extending the length of time of the flushing (the time A in FIG. 15) even when the standby time increases. Instead, the length of time of the ink agitation driving (the second preparatory driving) is made longer by a time (the time B in FIG. 15) based on the standby time, than in the case where the standby time is less than or equal to the time T2.

Even a short time of the second preparatory driving is highly effective to lower the increased viscosity of the ink because the second preparatory driving is performed just before printing. That is, in the case where the standby time from the preceding printing is long, extending the length of time of the second preparatory driving is more effective than extending the length of time of the first preparatory driving. Thus, even in the case where, as illustrated in FIG. 15, the extension time B of the second preparatory driving (the ink agitation driving) is made shorter than the extension time A of the first preparatory driving (the flushing), the same effects can be obtained, and the total time required until the start of printing can be reduced. The time T2in this modification is one example of a second time.

Seventh Modification

While the controller 40 controls the ink-jet head 26 to perform the second preparatory driving simultaneously with the detection movement of the carriage 25 in the above-described embodiment, the controller 40 may control the ink-jet head 26 to perform the second preparatory driving at a timing different from the detection movement.

Eighth Modification

In the above-described embodiment, the ink-jet head 26 is a serial ink-jet head that ejects the ink onto the recording sheet 100 while being moved with the carriage 25 in the scanning direction. In a modification, the ink-jet head 26 may be a line ink-jet head in which a multiplicity of nozzles are arranged in the widthwise direction of the recording sheet 100.

Ninth Modification

In the above-described embodiment, the maintenance device 6 covers the nozzles 31 of the ink-jet head 26 using the cap member 36 moved upward and downward with respect to the ink-jet head 26. However, the capping device is not limited to the device having this construction. For example, there is known a capping device for a line ink-jet head. This capping device includes a lip member disposed so as to surround the periphery of the ink-jet head and movable upward and downward with respect to the ink-jet head. This lip member is brought into contact with a platen, so that nozzles of the ink-jet head are covered with the platen and the lip member.

What is claimed is:

1. An image recording apparatus, comprising:

an ink-jet head comprising (i) a plurality of nozzles through which the ink-jet head ejects ink and (ii) an energy applier configured to apply ejection energy to the ink, the ejection energy causing the ink to be ejected from the plurality of nozzles;

a medium supplier configured to supply a recording medium to a recording start position at which the ink-jet head is started to record an image on the recording medium;

a first sensor provided on a supply path through which the recording medium is to be supplied to the ink-jet head by the medium supplier, the first sensor being configured to detect the recording medium supplied to the ink-jet head by the medium supplier; and a controller configured to perform:

controlling the energy applier to perform first preparatory driving before the ink-jet head performs image recording on the recording medium, the first preparatory driving comprising flushing in which the ink-jet head discharges the ink from the plurality of nozzles;

controlling the energy applier to perform second preparatory driving after the first preparatory driving and detection of the recording medium by the first sensor, the second preparatory driving comprising one of the flushing and ink agitation driving in which the ink in the plurality of nozzles are agitated without being ejected; and controlling the energy applier to perform the second preparatory driving in accordance with an elapsed time extending from an input of a recording command to the detection of the recording medium by the first sensor.

2. The image recording apparatus according to claim 1, wherein the controller is configured to increase a length of time of the second preparatory driving with increase in the elapsed time.

3. The image recording apparatus according to claim 1, wherein the controller is configured to control the ink-jet head to perform the second preparatory driving when the elapsed time is greater than a first time and configured to control the ink-jet head not to perform the second preparatory driving when the elapsed time is less than or equal to the first time.

4. The image recording apparatus according to claim 1, wherein the controller is configured to control the ink-jet head to perform the second preparatory driving during supply of the recording medium by the medium supplier to the recording start position after the detection of the recording medium by the first sensor.

5. The image recording apparatus according to claim 4, further comprising:

a carriage configured to support the ink-jet head and movable with the ink-jet head in a scanning direction intersecting a direction in which the recording medium is to be supplied; and a second sensor provided on the carriage and configured to detect the recording medium supplied to the recording start position by the medium supplier, wherein the controller is configured to perform:

when the recording medium is supplied to the recording start position by the medium supplier, controlling the carriage to perform detection movement in which the carriage is moved in the scanning direction for the second sensor to detect the recording medium; and controlling the ink-jet head to perform the second preparatory driving during the detection movement.

6. The image recording apparatus according to claim 5, wherein the controller is configured to control the ink-jet head to perform the ink agitation driving as the second preparatory driving during the detection movement.

7. The image recording apparatus according to claim 4, further comprising a carriage configured to support the ink-jet head and movable with the ink-jet head in a scanning direction intersecting a direction in which the recording medium is to be supplied, wherein the controller is configured to perform:

controlling the carriage to move from a reference position in the scanning direction and the ink-jet head to start performing image recording on the recording medium after the recording medium is supplied to the recording start position and thereafter the carriage is moved to the reference position that is located on an outer side of the recording medium in the scanning direction; and controlling the ink-jet head to perform the second preparatory driving during movement of the ink-jet head from the reference position to a position at which the ink-jet head ejects the ink from the plurality of nozzles onto the recording medium to perform image recording on the recording medium.

8. The image recording apparatus according to claim 7, wherein the medium supplier is capable of supplying a plurality of kinds of recording media respectively having different width in the scanning direction, each as the recording medium, and wherein the controller is configured to increase a length of time of the second preparatory driving with increase in distance between the reference position and an edge of the recording medium in the scanning direction.

9. The image recording apparatus according to claim 1, further comprising a capping device configured to be switched between a capping state in which the plurality of nozzles are covered and an uncapping state in which the plurality of nozzles are exposed to air, wherein the controller is configured to perform:

switching the capping device to the uncapping state when the recording command is input;

measuring, as the elapsed time, a length of time extending from the switching of the capping device to the uncapping state to the detection of the recording medium by the first sensor; and controlling the second preparatory driving based on the measured elapsed time.

10. The image recording apparatus according to claim 1, wherein the controller is configured to make a length of time of the second preparatory driving longer when a standby time extending from an end of a preceding image recording to an input of the recording command is greater than a second time than when the standby time is less than or equal to the second time.

* * * * *